US010488809B2

(12) United States Patent
Mizutani

(10) Patent No.: US 10,488,809 B2
(45) Date of Patent: Nov. 26, 2019

(54) DEVELOPER SUPPLYING DEVICE AND IMAGE FORMING APPARATUS THEREWITH

(71) Applicant: KYOCERA Document Solutions Inc., Osaka (JP)

(72) Inventor: Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/119,478

(22) Filed: Aug. 31, 2018

(65) Prior Publication Data

US 2019/0146404 A1 May 16, 2019

(30) Foreign Application Priority Data

Nov. 13, 2017 (JP) ..... 2017-217973

(51) Int. Cl.
*G03G 21/16* (2006.01)
*G03G 15/08* (2006.01)

(52) U.S. Cl.
CPC ..... *G03G 21/16* (2013.01); *G03G 15/0862* (2013.01); *G03G 2215/0897* (2013.01)

(58) Field of Classification Search
None
See application file for complete search history.

(56) References Cited

U.S. PATENT DOCUMENTS

2012/0243886 A1* 9/2012 Sunayama ..... G03G 15/0856 399/27
2014/0270817 A1* 9/2014 Ikebata ..... G03G 15/0862 399/27
2014/0286678 A1 9/2014 Sunayama ..... 399/255

FOREIGN PATENT DOCUMENTS

JP 2005266058 A * 9/2005
JP 2012-198368 A 10/2012

OTHER PUBLICATIONS

JP_2005266058_A_T MachineTranslation Japan, 2005, Masayuki.*

* cited by examiner

*Primary Examiner* — Victor Verbitsky
(74) *Attorney, Agent, or Firm* — Stein IP, LLC

(57) ABSTRACT

A developer supplying device has a storage container, a detection sensor, and a cleaning member. The storage container stores developer. The detection sensor has a detection face making contact with the developer in the storage container and detects the amount of developer in the storage container. The cleaning member cleans the detection face by making contact with the detection face. The storage container has a sensor movement face formed arc-shaped about a predetermined center as seen in a sectional view. The detection sensor is configured to be movable in the up/down direction along the sensor movement face. The cleaning member rotates about the predetermined center as a rotation axis.

8 Claims, 4 Drawing Sheets

DEVELOPER SUPPLYING DEVICE AND IMAGE FORMING APPARATUS THEREWITH

INCORPORATION BY REFERENCE

This application is based upon and claims the benefit of priority from the corresponding Japanese Patent Application No. 2017-217973 filed on Nov. 13, 2017, the entire contents of which are incorporated herein by reference.

BACKGROUND

The present disclosure relates to a developer supplying device, and to an image forming apparatus incorporating a developer supplying device. More particularly, the present disclosure relates to a developer supplying device including a storage container which stores developer supplied to a developing device and a detection sensor which detects the amount of developer in a storage container, and to an image forming apparatus incorporating such a developer supplying device.

In image forming apparatuses, a latent image formed on an image carrying member comprising a photosensitive member or the like is made visible by being developed into a toner image by a developing device. As such an image forming apparatus, there is known an image forming apparatus incorporating a toner container which is provided so as to be removable from the apparatus main body and which stores developer, and an intermediate hopper (developer supplying device) which stores the developer fed from the toner container and which supplies the developer to the developing device.

An intermediate hopper includes a storage container which stores developer, and a detection sensor which is fixed at a predetermined position in the storage container and which detects the amount of developer in the storage container. When the detection sensor detects that the amount of developer in the storage container becomes less than a predetermined amount, developer is fed from a toner container to the storage container. After feeding operation for feeding developer from the toner container to the storage container is started, if, at the lapse of a given time, the amount of developer in the storage container does not become equal to or more than a predetermined amount, a user is notified by a notifying means that the toner container is empty.

In this way, providing the intermediate hopper makes it possible to keep printing until the storage container is empty even when the toner container is empty. That is, by preparing a new toner container before the storage container is empty, it is possible to prevent printing operation from becoming impossible.

SUMMARY

According to one aspect of the present disclosure, a developer supplying device includes a storage container, a supplying member, a detection sensor, and a cleaning member. The storage container includes a developer receiving port to which developer is fed, and stores developer. The supplying member is provided in the storage container, and supplies the developer to a developing device. The detection sensor includes a detection face making contact with the developer in the storage container, and detects the amount of developer in the storage container. The cleaning member cleans the detection face by making contact with the detection face. The storage container includes a sensor movement face formed arc-shaped in the up/down direction about a predetermined center inside the storage container as seen in a sectional view. The detection sensor is configured to be movable in the up/down direction along the sensor movement face. The cleaning member rotates about the predetermined center as a rotation axis.

Further features and advantages of the present disclosure will become apparent from the description of embodiments given below.

DETAILED DESCRIPTION

Hereinafter, with reference to the accompanying drawings, an embodiment of the present disclosure will be described.

Figure 1:
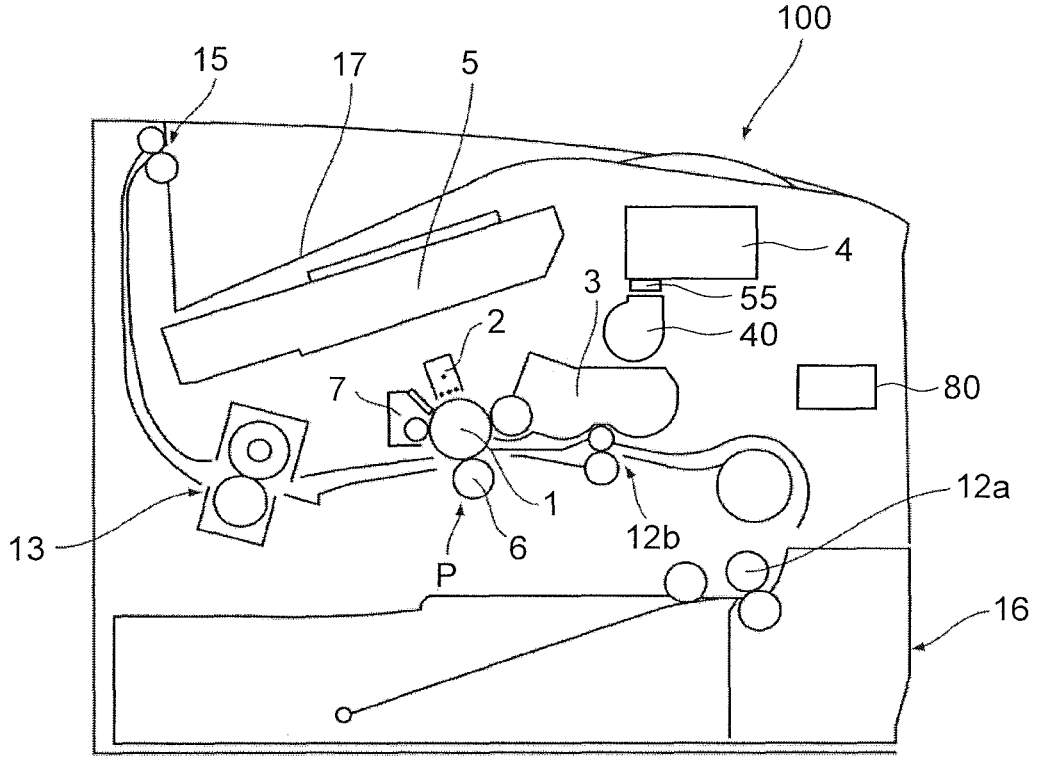
FIG. 1 is a sectional view schematically showing a structure of an image forming apparatus provided with an intermediate hopper (developer supplying device) according to one embodiment of the present disclosure.

FIG. 1 is a schematic sectional view showing the construction of an image forming apparatus 100 provided with an intermediate hopper (developer supplying device) 40 according to one embodiment of the present disclosure, the right side of the illustration corresponding to the front side of the image forming apparatus 100. As shown in FIG. 1, in a lower part of a main body of the image forming apparatus 100 (here, a monochrome printer), a sheet cassette 16 that stores a stack of transfer sheet is arranged. Over the sheet cassette 16, a sheet conveying passage is formed which extends approximately horizontally from the front to the rear of the main body and then extends upward to a discharge tray 17 formed on the top face of the main body. Along the sheet conveying passage, there are arranged, from the upstream side, a sheet feed roller 12*a*, a registration roller pair 12*b*, an image forming section P, a fixing device 13, and a discharge roller pair 15.

The image forming section P is composed of a photosensitive drum 1 pivoted so as to be rotatable in the clockwise direction in FIG. 1, a charging unit 2 arranged around the photosensitive drum 1, a developing device 3, a cleaning section 7, a transfer roller 6 arranged so as to face the photosensitive drum 1 across the sheet conveying passage, and an exposing device 5 arranged over the photosensitive drum 1. Over the developing device 3, there are arranged a toner container 4 which is provided so as to be removable from the image forming apparatus 100 and which stores developer (hereinafter, also referred to simply as toner), and the intermediate hopper 40 which stores the developer fed from the toner container 4 and which supplies the developer to the developing device 3.

A predetermined voltage is applied to the charging unit 2 so that the surface of the photosensitive drum 1 is electrostatically charged uniformly. Then, by irradiation with light from the exposing device 5, an electrostatic latent image based on an image data entered is formed on the photosensitive drum 1, toner is attached to the electrostatic latent image by the developing device 3, and a toner image is formed on the surface of the photosensitive drum 1. A transfer sheet (unillustrated) is fed, with predetermined timing, from the registration roller pair 12*b* to a nip portion (transfer position) between the photosensitive drum 1 and the transfer roller 6, and the toner image on the surface of the photosensitive drum 1 is transferred to the transfer sheet by the transfer roller 6.

The transfer sheet having the toner image transferred to it is separated from the photosensitive drum 1, is conveyed toward the fixing device 13, and is heated and pressed in the fixing device 13, so that the toner image transferred to the transfer sheet is fixed.

The transfer sheet having undergone image formation in the image forming section P and the fixing device 13 is discharged onto the discharge tray 17 by the discharge roller pair 15. On the other hand, the toner that remains on the surface of the photosensitive drum 1 after transfer is removed by the cleaning section 7. Then, the photosensitive drum 1 is charged by the charging unit 2 again, and image forming is performed similarly.

Next, the structure of and around the developing device 3 will be described.

Figure 2:
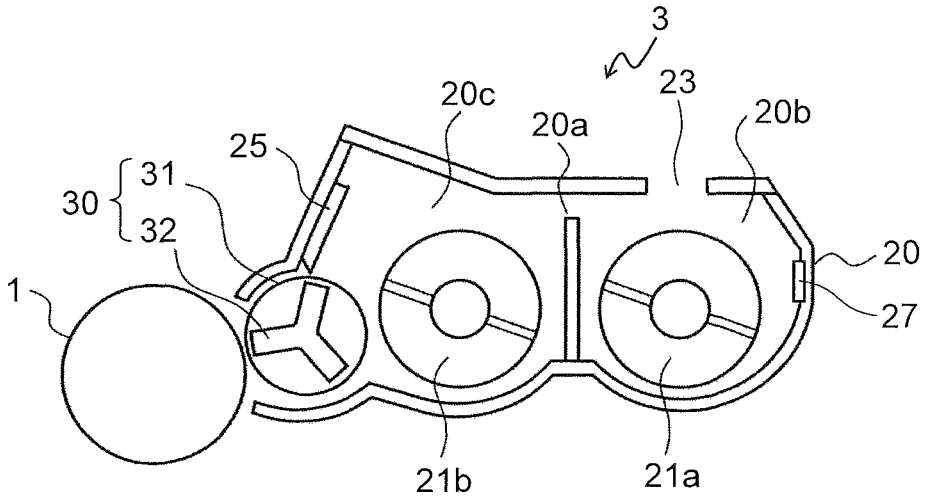
FIG. 2 is a sectional view showing a structure of a developing device in the image forming apparatus according to the one embodiment of the present disclosure.

As shown in FIG. 2, the developing device 3 includes a first stirring screw 21*a*, a second stirring screw 21*b*, a developing roller 30, and a regulating blade 25 inside a developer container 20 that stores developer. Here, magnetic one-component developer is used as developer.

The interior of the developer container 20 is divided by a partition wall 20*a* extending in a longitudinal direction (the direction perpendicular to the plane of FIG. 2) into a first stirring chamber 20*b* and a second stirring chamber 20*c*. In the first stirring chamber 20*b* and the second stirring chamber 20*c*, the first stirring screw 21*a* and the second stirring screw 21*b* are arranged respectively. The partition wall 20*a* is not provided in opposite end parts of the developer container 20 in the longitudinal direction, and these parts serve as passages (developer passing portions) through which toner moves between the first stirring chamber 20*b* and the second stirring chamber 20*c*.

The developing roller 30 is composed of a developing sleeve 31 and a magnet member 32 which has a plurality of magnetic pole (here, three poles) and which is fixed inside the developing sleeve 31. A developing bias having the same polarity as toner (positively charged toner) is applied to the developing roller 30. The toner on the surface of the developing roller 30 flies to the photosensitive drum 1 and attaches to a photosensitive layer, and thus a toner image is formed on the surface of the photosensitive drum 1.

The regulating blade 25 serves to regulate the amount of toner fed to the photosensitive drum 1, that is, the amount of toner attached to the developing roller 30, and as the regulating blade 25, for example, a magnetic member of SUS (stainless steel) or the like is used. The regulating blade 25 is arranged to form a predetermined gap (0.2 to 0.3 mm) between the tip end of the regulating blade 25 and the developing roller 30. By a magnetic field which occurs in an interval and the gap between the regulating blade 25 and the developing roller 30, the amount of toner attached to the developing roller 30 is regulated, and a thin toner layer of several tens of microns is formed on the surface of the developing roller 30.

In the top face of the developer container 20, a developer supplying port 23 is provided. According to the result of detection by a toner sensor 27 which detects the amount of toner in the developer container 20, developer is supplied from the intermediate hopper 40 (see the FIG. 1).

Figure 3:
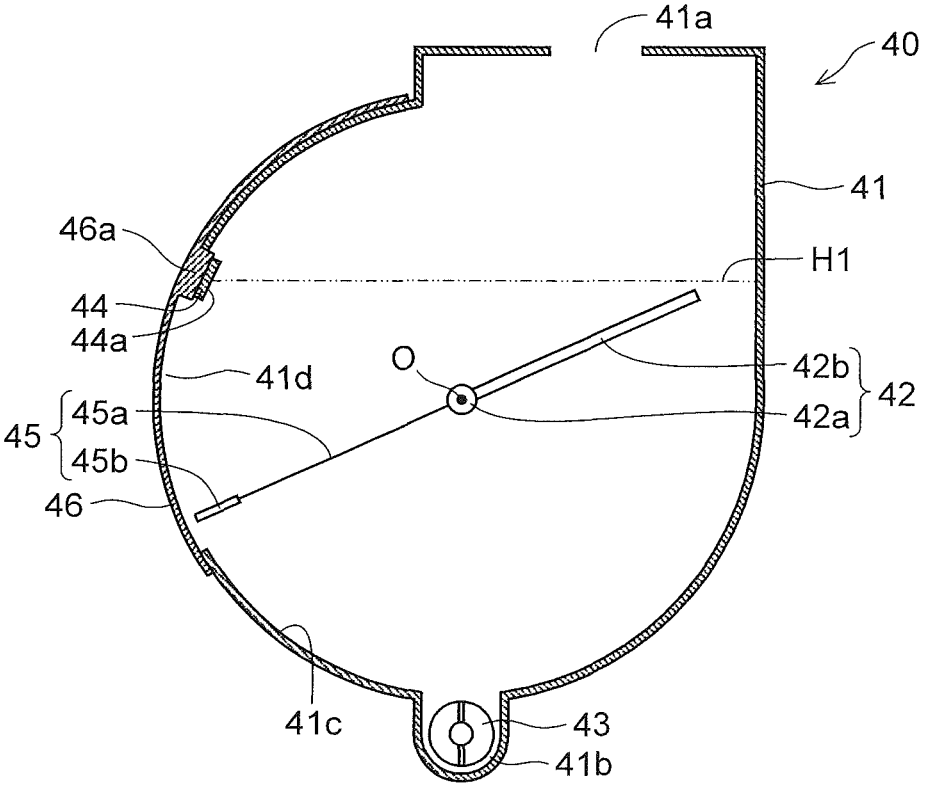
FIG. 3 is a sectional view showing a structure of the intermediate hopper according to the one embodiment of the present disclosure, showing a state where a detection sensor is arranged at a high position.

As shown in FIG. 3, the intermediate hopper 40 includes a storage container 41 which stores developer, a stirring member 42 which stirs developer, a supplying screw 43 (supplying member) which supplies developer to the developing device 3, and a detection sensor 44 which detects the amount of developer in the storage container 41.

In the top face of the storage container 41, a developer receiving port 41*a* to which developer is fed from the toner container 4 is provided. In a lower part of the storage container 41, a recessed part 41*b* in which the supplying screw 43 is arranged is provided. To one end part of the recessed part 41*b* in its longitudinal direction (the direction perpendicular to the plane of FIG. 3), a developer dropping port (unillustrated) which leads to the developer supplying port 23 in the developer container 20 is provided. When the supplying screw 43 rotates, developer is conveyed in the recessed part 41*b* and drops from the developer dropping port (unillustrated), so that the developer is supplied to the developer container 20.

In at least a part of the storage container 41 (a region including a moving range of the detection sensor 44), a sensor movement face 41*c* is provided which is formed arc-shaped in the up/down direction about a predetermined center O inside the storage container 41 as seen in a sectional view.

The detection sensor 44 is so arranged that a detection face 44*a* makes contact with the developer in the storage container 41, and the detection sensor 44 detects the amount of developer in the storage container 41. The detection sensor 44, as will be described later, is configured to be movable in the up/down direction along the sensor movement face 41*c*.

The detection sensor 44 is a sensor (piezoelectric sensor) composed of, for example, a piezoelectric element. The piezoelectric sensor serves to extract impact or vibration as an electrical signal, using the property of the piezoelectric element outputting, on receiving impact or vibration from outside, a voltage proportional to its magnitude. The piezoelectric sensor has the advantages of small size, light weight, and high sensitivity.

The stirring member 42 is composed of a rotary shaft part 42*a* which is supported rotatably on the storage container 41 and which is coaxial with the predetermined center O, and a paddle part 42*b* which is formed integrally with the rotary shaft part 42*a*. When the stirring member 42 rotates, the developer in the storage container 41 is stirred.

On the rotary shaft part 42*a* of the stirring member 42, a cleaning member 45 is fixed which, by making contact with the detection face 44*a* of the detection sensor 44, cleans the detection face 44*a*. The cleaning member 45 is composed of a shaft part 45*a* which is formed of one elastic metal wire member (spring member) and which extends in a radial direction of the rotary shaft part 42*a*, and a sliding part 45*b* which slides on the detection face 44*a* of the detection sensor 44. The sliding part 45*b* may comprise a film member, a sponge member, or a rubber member attached to an end part of the shaft part 45*a*, or may comprise a wire member formed by bending an end part of the shaft part 45*a*. As the rotary shaft part 42*a* of the stirring member 42 rotates, the cleaning member 45 rotates about the predetermined center O as a rotation axis, so that the sliding part 45*b* scrapes off the developer attached on the detection face 44*a* of the detection sensor 44.

The detection sensor 44 is fixed (held) on the inner surface of a holding member 46. As the holding member 46 moves in the up/down direction along the sensor movement face 41*c* in the storage container 41, the detection sensor 44 also moves in the up/down direction along the sensor movement face 41*c*.

Specifically, at a predetermined position on the sensor movement face 41*c* in the storage container 41, a slit 41*d* extending in the up/down direction is formed. The holding member 46 is formed in the shape of an arc about the predetermined center O as seen in a sectional view so as to extend in the up/down direction along the slit 41*d*.

Figure 4:
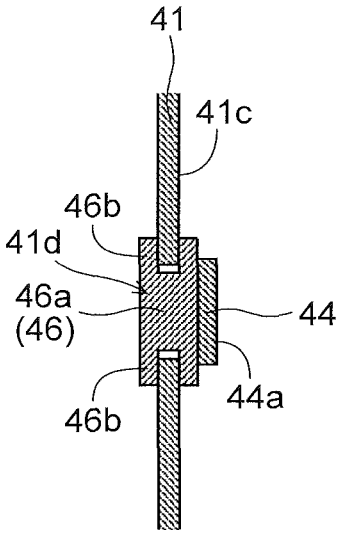
FIG. 4 is a sectional view showing, from above, a structure of and around the detection sensor in the intermediate hopper according to the one embodiment of the present disclosure.
Figure 5:
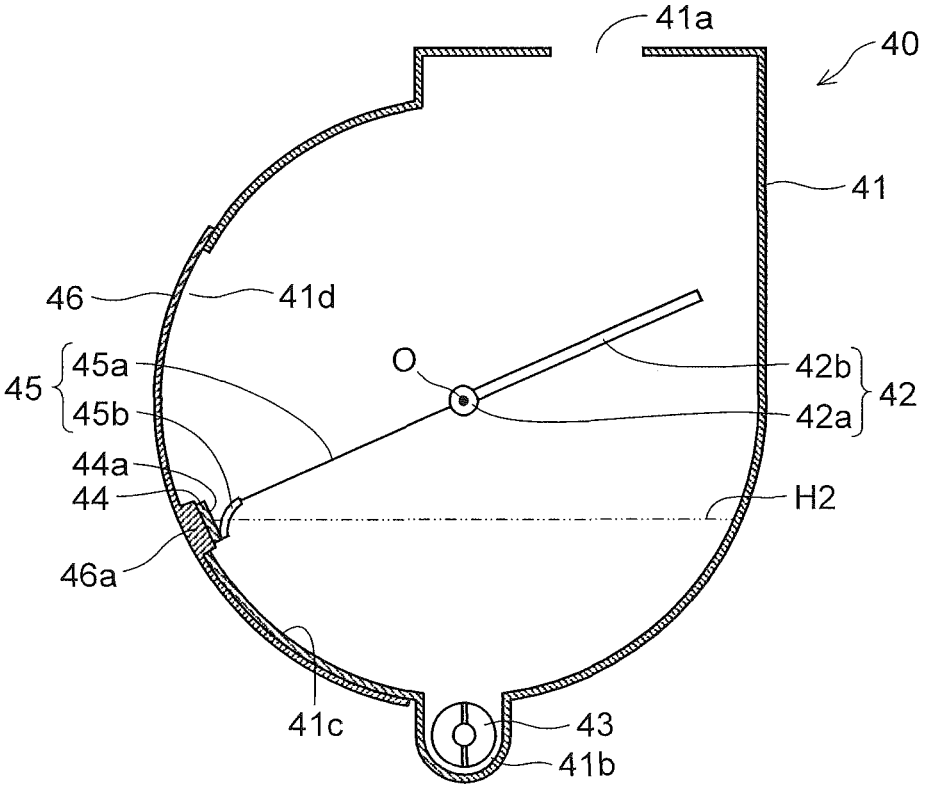
FIG. 5 is a sectional view showing a structure of the intermediate hopper according to the one embodiment of the present disclosure, showing a state where the detection sensor is arranged at a low position.

In a middle part of the holding member 46 in its longitudinal direction (the up/down direction), a fitting part 46*a* fitted with the detection sensor 44 is provided. As shown in FIG. 4, in each of opposite end parts of the fitting part 46*a*, an engagement part 46*b* is provided which is in a U-shape so as to grip a side rim of the slit 41*d* in its thickness direction. As shown in FIG. 3 to FIG. 5, with the slit 41*d* closed, the holding member 46 is movable along the slit 41*d*. The holding member 46 moves in the up/down direction along the sensor movement face 41*c* by the action of a moving mechanism 50 (see FIG. 6) which comprises a driving motor, a gear, and the like.

In this embodiment, when the amount of developer in the storage container 41 becomes less than a predetermined amount (the amount corresponding to the height position of the detection sensor 44), the developer is fed from the toner container 4 via the developer receiving port 41*a*. At a lower part of the toner container 4, as shown in FIG. 1, a feeding member 55 is provided which includes a screw that feeds the developer from the toner container 4 to the storage container 41. The feeding member 55 is controlled by a control section 80 which controls the whole image forming apparatus 100.

Figure 6:
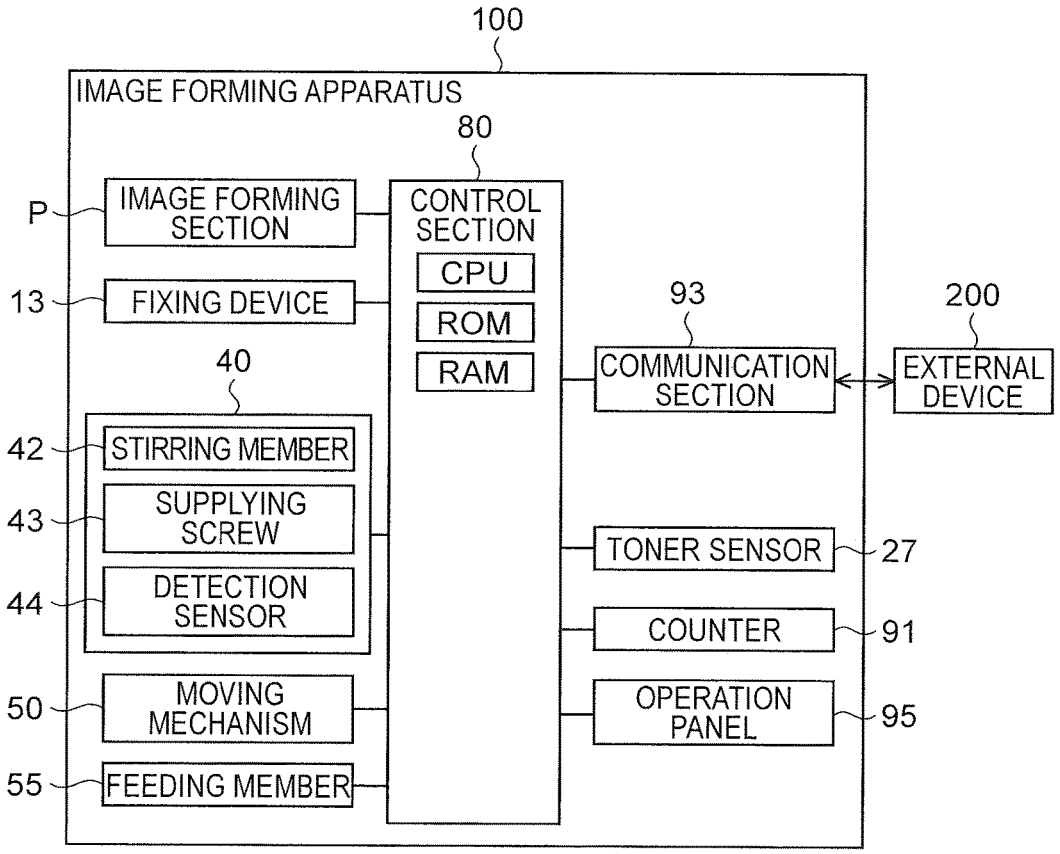
FIG. 6 is a block diagram showing part of controlling channels in the image forming apparatus according to the one embodiment.

As shown in FIG. 6, the control section 80 is composed of a CPU (central processing unit), a ROM (read-only memory), a RAM (random-access memory), and the like. The control section 80 is configured to be able to control the image forming section P, the fixing device 13, the stirring member 42, the supplying screw 43, the moving mechanism 50, the feeding member 55, and the like. The control section 80 is configured to be able to communicate with the toner sensor 27, the detection sensor 44, a counter 91, a communication section 93, and an operation panel 95, of which the last three will be described later.

In the ROM, data and the like are stored which are not changed when the image forming apparatus 100 is in use, such as a program for control of the image forming apparatus 100, values necessary for control, and the like. In the RAM, there are stored necessary data which occurs in the process of controlling the image forming apparatus 100, data which is temporarily needed to control the image forming apparatus 100, and the like.

The counter 91 can count the number of printed sheets and transmits the result to the control section 80.

The communication section 93 performs wired or wireless data communication with an external device 200, such as a personal computer or the like, via a communication network, such as the Internet, a LAN, or the like. In this embodiment, as will be described later, the communication section 93 transmits the data of an order for a new toner container 4 to a delivery center, a dealer, or the like.

Here, in this embodiment, the control section (consumption amount calculating part) 80 calculates the amount of developer consumed in printing operation. For example, the control section 80 calculates the amount of developer consumed in printing operation during a predetermined period based on the average coverage rate and the number of printed sheets during the predetermined period.

In the image forming apparatus 100, the control section 80 sets the height position of the detection sensor 44 based on the amount of developer consumed in printing operation during the predetermined period (for example, a week or a month). Here, as the amount of developer consumed in printing operation during the predetermined period increases, the control section 80 sets the height position of the detection sensor 44 higher. That is, for a customer printing in large quantities, for example, as shown in FIG. 3, the height position of the detection sensor 44 is set higher, and for a customer printing in small quantities, for example, as shown in FIG. 5, the height position of the detection sensor 44 is set lower.

The height position of the detection sensor 44 is set, for example, at a position that corresponds to the amount of developer sufficient for printing operation for about a week without developer being fed from the toner container 4 (with the toner container 4 empty). The height position of the detection sensor 44 is set on a customer-by-customer basis to suit their manner of use. When the detection sensor 44 is arranged, for example, at the position in FIG. 3, the detection sensor 44 detects whether or not the amount of developer is higher than a height H1. When the detection sensor 44 is arranged, for example, at the position in FIG. 5, the detection sensor 44 detects whether or not the amount of developer is higher than a height H2.

When the developer in the developer container 20 is consumed as printing operation proceeds, a toner low signal is transmitted from the toner sensor 27 to the control section 80; then the control section 80 supplies the developer from the intermediate hopper 40 to the developer container 20 by use of the supplying screw 43. Then, when the amount of developer in the developer container 20 becomes equal to or more than a certain amount, and a toner high signal is transmitted from the toner sensor 27 to the control section 80, then the control section 80 stops rotating the supplying screw 43, and stops supplying the developer to the developer container 20.

After the developer starts to be supplied from the intermediate hopper 40 to the developer container 20 by use of the supplying screw 43, if, at the lapse of a given time, the amount of developer in the developer container 20 does not become equal to or more than a certain amount (if the toner high signal is not transmitted from the toner sensor 27 to the control section 80), the control section 80 recognizes that the intermediate hopper 40 is empty. Then, the control section 80 stops supplying the developer from the intermediate hopper 40 to the developer container 20, makes the operation panel 95 (see FIG. 6) notify that the intermediate hopper 40 is empty, and stops printing operation.

When the amount of developer in the storage container 41 of the intermediate hopper 40 becomes less than a predetermined amount (the amount corresponding to the height position of the detection sensor 44) as the developer is supplied from the intermediate hopper 40 to the developer container 20, the toner low signal is transmitted from the detection sensor 44 to the control section 80. Thus, the control section 80 feeds the developer from the toner container 4 to the storage container 41 by use of the feeding member 55. Then, when the amount of developer in the storage container 41 becomes equal to or more than the predetermined amount, and the toner high signal is transmitted from the detection sensor 44 to the control section 80, then the control section 80 stops rotating the feeding member 55, and stops feeding the developer to the storage container 41.

After the developer starts being fed from the toner container 4 to the storage container 41 by use of the feeding member 55, if, at the lapse of a given time, the amount of developer in the storage container 41 does not become equal to or more than a certain amount (if the toner high signal is not transmitted from the detection sensor 44 to the control section 80), the control section 80 recognizes that the toner container 4 is empty. Then, the control section 80 stops feeding the developer from the toner container 4 to the storage container 41, makes the operation panel 95 notify that the toner container 4 is empty, and then the orders a (new) toner container 4 for replacement via the communication section 93.

In this embodiment, as described above, the storage container 41 includes the sensor movement face 41*c* formed arc-shaped about the predetermined center O as seen in a sectional view. The detection sensor 44 which detects the amount of developer in the storage container 41 is configured to be movable in the up/down direction along the sensor movement face 41*c*. Thus, moving the detection sensor 44 in the up/down direction makes it possible to adjust (vary) the amount of developer in the storage container 41 at the time when the toner container 4 becomes empty.

In this way, for a customer printing in large quantities, by moving the detection sensor 44 to, for example, the uppermost position (the position in FIG. 3) in the moving range in advance, it is possible to increase the amount of developer in the storage container 41 at the time when the toner container 4 becomes empty. This helps prevent the developer in the storage container 41 from running out too soon, and thus it is possible to prevent the image forming apparatus 100 from going into a state where printing operation cannot be performed. On the other hand, for a customer printing in small quantities, by moving the detection sensor 44 to, for example, the lowermost positon (the position in FIG. 5) in the moving range in advance, it is possible to reduce the amount of developer in the storage container 41 at the time when the toner container 4 becomes empty, and thus it is no longer necessary to store a new toner container 4 for a long period.

The detection sensor 44 is configured to be movable in the up/down direction along the sensor movement face 41*c* formed arc-shaped about the predetermined center O. The cleaning member 45 rotates about the predetermined center O as the rotation axis. Thus, wherever the detection sensor 44 is arranged in the up/down direction, it is possible to clean the detection face 44*a* of the detection sensor 44 with the cleaning member 45, and thus it is possible to suppress a drop on the detection accuracy of the detection sensor 44.

As described above, the cleaning member 45 is provided on the rotary shaft part 42*a* of the stirring member 42. Thus, by rotating the stirring member 42, it is possible to rotate the cleaning member 45, and thus there is no need to separately provide a driving force which rotates the cleaning member 45.

As described above, the sensor movement face 41*c* is provided with the slit 41*d* extending in the up/down direction. The holding member 46 is provided to be, with the slit 41*d* closed, movable along the slit 41*d*. Thus, by moving the detection sensor 44 in the up/down direction along the sensor movement face 41*c*, it is possible to easily prevent the developer from leaking through the slit 41*d* in the storage container 41.

As described above, the control section 80 sets the height position of the detection sensor 44 based on the amount of developer consumed in printing operation during the predetermined period. Thus, according to the amount of printing (the manner of use) by customers, it is possible to automatically adjust (vary) the amount of developer in the storage container 41 at the time when the toner container 4 becomes empty.

As described above, as the amount of developer consumed in printing operation during the predetermined period increases, the control section 80 sets the height position of the detection sensor 44 higher. Thus, for a customer printing in large quantities, it is possible to increase the amount of developer in the storage container 41 at the time when the toner container 4 becomes empty, and for a customer printing in small quantities, it is possible to reduce the amount of developer in the storage container 41 at the time when the toner container 4 becomes empty.

As described above, the control section 80 calculates the amount of developer consumed in printing operation based on the average coverage rate and the number of printed sheets during the predetermined period. Thus, it is possible to easily calculate the amount of developer consumed in printing operation during the predetermined period.

As described above, if the detection sensor 44 detects that the amount of developer in the storage container 41 is less than the predetermined amount (when the toner low signal is transmitted from the detection sensor 44 to the control section 80), the control section 80 feeds the developer from the toner container 4 to the storage container 41, and if the detection sensor 44 detects that the amount of developer in the storage container 41 has become equal to or more than the predetermined amount (when the toner high signal is transmitted from the detection sensor 44 to the control section 80), the control section 80 stops feeding the developer from the toner container 4 to the storage container 41. Thus, the amount of developer in the storage container 41 can be (easily) made substantially constant (equal to the predetermined amount).

As described above, after the developer starts to be fed from the toner container 4 to the storage container 41, if, at the lapse of a given time, the detection sensor 44 does not detect that the amount of developer in the storage container 41 is equal to or more than the predetermined amount (if the toner high signal is not transmitted from the detection sensor 44 to the control section 80), the control section 80 stops feeding the developer from the toner container 4 to the storage container 41 and orders a toner container 4 for replacement via the communication section 93. In this way, it is not necessary to keep an inventory of the toner container 4. When the image forming apparatus 100 which automatically orders the toner container 4 is used, it is impossible to adjust the delivery timing of the toner container 4, for example, as does a customer printing in small quantities by putting order timing forward. Thus, it is particularly effective to apply the present disclosure when the image forming apparatus 100 which automatically orders the toner container 4 is used in order to adjust the amount of developer in the storage container 41 according to the manner of use by customers.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, although the embodiments described above deal with an example where the present disclosure is applied to a monochrome printer, this is not meant to limit the present disclosure. Needless to say, the present disclosure find applications in a variety of image forming apparatuses provided with a developer supplying device including a storage container which stores developer supplied to a developing device, and a detection sensor which detects the amount of developer in the storage container.

Although the embodiments described above deal with an example where the stirring member 42 is provided so as to rotate about the center (the predetermined center O) of an arc in the sensor movement face 41*c* as the rotation axis, this is not meant to limit the present disclosure. The stirring member 42 may be provided so as to rotate about other than the predetermined center O as the rotation axis. In this case, the cleaning member 45 may be provided on a rotary shaft part (a rotary shaft part which rotates about the predetermined center O as the rotation axis) other than the rotary shaft part 42*a* of the stirring member 42.

Although the embodiments described above deal with an example where the control section 80 automatically changes the height position of the detection sensor 44 by use of the moving mechanism 50, this is not meant to limit the present disclosure. For example, a service person may manually change the height position of the detection sensor 44. In this case, the service person may set the height position of the detection sensor 44 based on the amount of developer consumed in printing operation during the predetermined period (the amount of developer calculated by the control section 80).

Although the embodiments described above deal with an example where the detection sensor 44 is arranged at the uppermost position (the position in FIG. 3) or the lowermost positon (the position in FIG. 5) in the moving range, this is not meant to limit the present disclosure. The detection sensor 44 can be arranged at any position within the moving range.

Although the embodiments described above deal with an example where the detection sensor 44 is arranged at the predetermined height position based on the amount of developer consumed in printing operation during the predetermined period, this is not meant to limit the present disclosure. For example, in a configuration where the toner container 4 is not automatically ordered, the detection sensor 44 is arranged at the uppermost position (the position in FIG. 3). When the amount of developer in the storage container 41 has reduced as printing operation proceeds, developer feeding operation from the toner container 4 to the storage container 41 is performed. If, even then, the amount of developer in the storage container 41 does not become equal to or more than the predetermined amount (the height H1), the control section 80 makes the operation panel 95 notify (first notification) that the toner container 4 is empty. Then, after the detection sensor 44 is moved to the lowermost position (the position in FIG. 5), when the amount of developer in the storage container 41 has reduced as printing operation proceeds, developer feeding operation from the toner container 4 to the storage container 41 is performed. If, even then, the amount of developer in the storage container 41 does not become equal to or more than the predetermined amount (the height H2), the control section 80 makes the operation panel 95 notify (second notification) that the amount of developer in the storage container 41 has become very small (and the toner container 4 is empty). The image forming apparatus 100 may be configured as just described.

Although the embodiments described above deal with an example where the piezoelectric sensor is used as the detection sensor 44, this is not meant to limit the present disclosure. A contact type sensor other than the piezoelectric sensor may be used as the detection sensor 44.

Although the embodiments described above deal with an example where the magnetic one-component developer is used as developer, this is not meant to limit the present disclosure. The developer can be one-component developer or two-component developer, and furthermore, the developer can be magnetic or nonmagnetic.

The technical scope of the present disclosure covers any configuration obtained by appropriately combining the configurations of the embodiments and of the modified examples described above.

What is claimed is:

1. A developer supplying device comprising:

a storage container including a developer receiving port to which developer is fed, the storage container storing the developer;

a supplying member provided in the storage container, the supplying member supplying the developer to a developing device;

a detection sensor including a detection face which makes contact with the developer in the storage container, the detection sensor detecting an amount of developer in the storage container;

a cleaning member cleaning the detection face by making contact with the detection face; and a holding member holding the detection sensor, wherein the storage container includes a sensor movement face formed arc-shaped in an up/down direction about a predetermined center inside the storage container as seen in a sectional view;

the detection sensor is configured to be movable in the up/down direction along the sensor movement face;

the cleaning member rotates about the predetermined center as a rotation axis;

the sensor movement face is provided with a slit extending in the up/down direction; and the holding member extends along the slit, and is provided to be, with the slit closed, movable along the slit.

2. The developer supplying device according to claim 1, further comprising:

a stirring member rotating about the predetermined center as the rotation axis, the stirring member stirring the developer in the storage container, wherein the cleaning member is provided on a rotary shaft part of the stirring member.

3. An image forming apparatus comprising:

the developer supplying device according to claim 1;

a toner container storing the developer fed to the developer supplying device;

a feeding member feeding the developer from the toner container to the storage container;

the developing device to which the developer is supplied from the storage container; and a control section controlling the developer supplying device, the feeding member, and the developing device.

4. The image forming apparatus according to claim 3, wherein if the detection sensor detects that the amount of developer in the storage container is less than a predetermined amount, the control section feeds the developer from the toner container to the storage container, and if the detection sensor detects that the amount of developer in the storage container has become equal to or more than the predetermined amount, the control section stops feeding the developer from the toner container to the storage container.

5. The image forming apparatus according to claim 4, further comprising:

a communication section communicable via a communication network, wherein after the developer starts to be fed from the toner container to the storage container, if, at a lapse of a given time, the detection sensor does not detect that the amount of developer in the storage container is equal to or more than the predetermined amount, the control section stops feeding the developer from the toner container to the storage container, and orders a toner container for replacement via the communication section.

6. An image forming apparatus comprising:

a developer supplying device including a storage container which stores developer and a detection sensor which detects an amount of developer in the storage container;

a toner container storing the developer fed to the developer supplying device;

a feeding member feeding the developer from the toner container to the storage container;

a developing device to which the developer is supplied from the storage container;

a control section controlling the developer supplying device, the feeding member, and the developing device;

a moving mechanism controlled by the control section, the moving mechanism moving the detection sensor; and a consumption amount calculating part calculating an amount of developer consumed in printing operation, wherein the storage container includes a developer receiving port to which the developer is fed, and a sensor movement face formed arc-shaped in an up/down direction about a predetermined center inside the storage container as seen in a sectional view, the detection sensor includes a detection face which makes contact with the developer in the storage container, and is configured to be movable in the up/down direction along the sensor movement face, the moving mechanism moves the detection sensor in the up/down direction along the sensor movement face, the developer supplying device further includes a supplying member provided in the storage container and supplying the developer to the developing device, and a cleaning member cleaning the detection face by making contact with the detection face, the cleaning member rotates about the predetermined center as a rotation axis, and the control section sets a height position of the detection sensor based on the amount of developer consumed in printing operation during a predetermined period.

7. The image forming apparatus according to claim 6, wherein as the amount of developer consumed in printing operation during the predetermined period increases, the control section sets the height position of the detection sensor higher.

8. The image forming apparatus according to claim 6, wherein the consumption amount calculating part calculates the amount of developer consumed in printing operation based on an average coverage rate and a number of printed sheets during the predetermined period.

* * * * *